US005967956A

United States Patent [19]

Teeter

[11] Patent Number: 5,967,956

[45] Date of Patent: Oct. 19, 1999

[54] TILTING INVERSION EXERCISE TABLE MOUNT

[76] Inventor: Roger C. Teeter, 20720 Snag Is Dr., Sumner, Pierce County, Wash. 98390

[21] Appl. No.: 09/002,302

[22] Filed: Dec. 31, 1997

[51] Int. Cl.[6] ..... A63B 26/00

[52] U.S. Cl. ..... 482/144; 482/145; 606/244

[58] Field of Search ..... 482/95, 96, 131, 482/139, 142, 143, 144, 145, 907; 606/244; 108/6, 7, 8, 9; 403/321, 325

[56] References Cited

U.S. PATENT DOCUMENTS

| | | | |
|---|---|---|---|
| 845,291 | 2/1907 | Breckenridge | 403/321 |
| 2,450,430 | 10/1948 | Hight | 403/325 X |
| 4,534,555 | 8/1985 | McGowen | 482/144 |
| 4,546,972 | 10/1985 | Goyer | 482/144 |
| 4,867,143 | 9/1989 | Morin | 482/144 X |
| 5,551,937 | 9/1996 | Kwo | 402/144 |

*Primary Examiner*—Richard J. Apley
*Assistant Examiner*—William LaMarca
*Attorney, Agent, or Firm*—Robert W. Beach

[57] ABSTRACT

A mount for a tilting inversion exercise table includes a stand composed of spaced A-frames having spaced trunnion-supporting bearing plates with blind bearing slots receiving trunnions in such slots, and swingable keeper arms pivoted on the trunnion-supporting bearing plates and having hooked ends swingable into positions blocking escape of the trunnions from the bearing slots. Helical tension springs connected between the trunnion-supporting bearing plates and the keeper arms urge the arms into positions in which their hooked ends block escape of the trunnions from the blind bearing slots.

5 Claims, 3 Drawing Sheets

TILTING INVERSION EXERCISE TABLE MOUNT

BACKGROUND OF THE INVENTION

1. Field of the Invention

This invention relates to the supports for trunnions of a tilting inversion exercise table and particularly to keeper means for preventing inadvertent escape of the trunnions from their mounts.

2. Prior Art

Tilting inversion exercise tables are known, and the present invention relates to an improved type of pivotal support for such tables.

SUMMARY OF THE INVENTION

A principal object of the present is to improve the safety of use of a tilting inversion exercise table when a person exercising may execute more or less violent maneuvers.

A further object is to provide a safe tilting inversion exercise table which can be demounted quickly and easily.

The foregoing objects can be accomplished by mounting the tilting inversion exercise table by trunnions received in blind bearing slots provided in the apex plates of foldable A-frames and retained in such slots against inadvertent displacement from such slots by swingable keeper hooks retained in trunnion-retaining position by helical tension springs.

DETAILED DESCRIPTION

Figure 1:
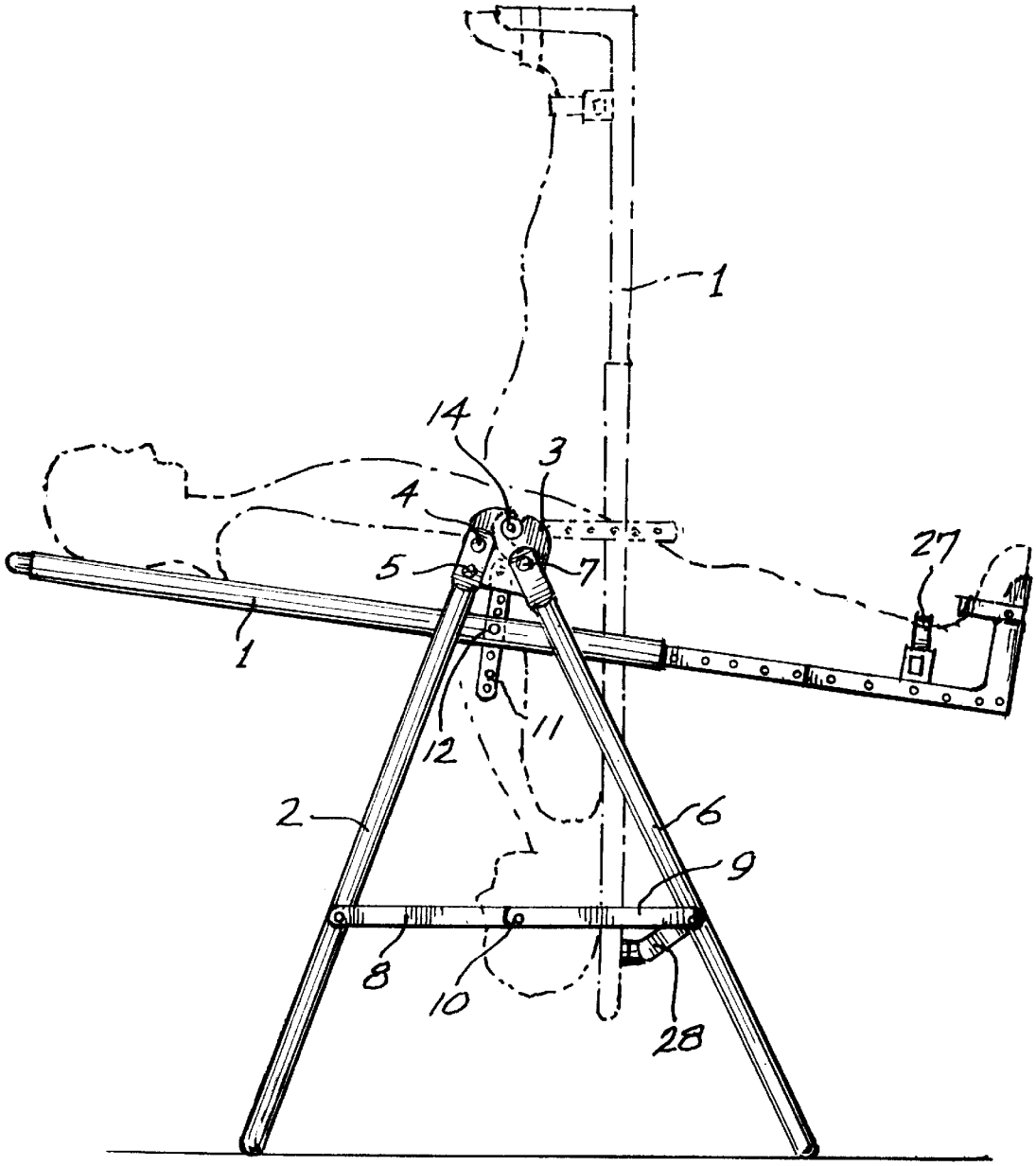
FIG. 1 is a side elevation of the tilting inversion exercise table.

The tilting inversion exercise table 1 is shown in generally horizontal position located between and supported from A-frames of a supporting stand. Each A-frame includes a leg 2, the upper end of which is secured to an apex-connecting plate 3 in rigid relationship by rivets or bolts 4 and 5 spaced lengthwise of the leg 2. The upper end of the other leg 6 of each A-frame is connected pivotally to its apex plate 3 by a pivot bolt 7 so that the leg 6 can swing about such pivot relative to the apex plate 3 and the other leg 2 of its A-frame.

When the A-frames are erected, their legs 2 and 6 are held in predetermined downwardly divergent relationship by a brace spaced from pivot 7 and composed of a link 8 pivoted to leg 2 and a link 9 pivoted to leg 6, the adjacent ends of which links are pivotally connected by pivot 10. When the links 8 and 9 are swung relative to each other by raising the pivot 10, the leg 6 is drawn toward the leg 2 until the legs lie in parallel folded relationship. During such movement, the leg 6 swings about its pivot 7 relative to apex plate 3.

The table 1 is hung from and between the A-frame stands by hanger bars 11 secured to opposite edges, respectively, of the table 1 by pins 12 extending through apertures 13 in the hanger bars 11. The upper ends of the hanger bars 11 are supported by trunnions 14 in the form of stubs secured by bolts 15 to the upper end of the hanger bars. Each stub has a collar 16 spaced from an end flange 17 of the stub to provide an annular groove 18 of a width just slightly greater than the thickness of the apex plate 3.

The upper edge of each apex plate 3 has in it an upwardly-opening blind slot 19 of a width substantially equal to the diameter of the bottom of trunnion groove 18. The trunnion groove 18 of each hanger bar is fitted into the blind slot of its apex plate 3 in the manner illustrated in FIGS. 2, 4 and 5. The trunnion is lowered relative to the apex plate with the groove 18 in registration with the blind slot in the apex plate. The trunnion is lowered from the position shown in FIG. 2 through the position shown in FIG. 4 to the seated position shown in FIG. 5 in which the bottom of the groove 18 seats on the concave blind end of the slot 19 so that the apex plate becomes a trunnion-supporting bearing plate.

Figure 5:
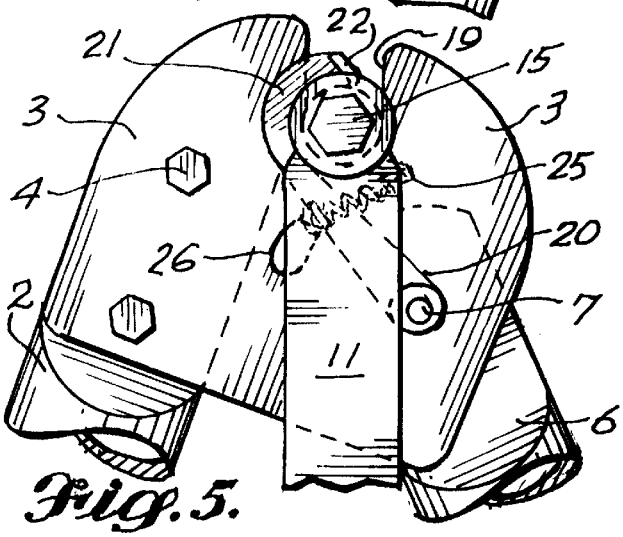
FIG. 5 is a side elevation of a table mount similar to FIGS. 2 and 4 but showing parts in a still different relationship.

The trunnion 14 is held in the seated position of FIG. 5 by a swingable keeper arm 20 mounted on the pivot 7. The swinging end of the keeper arm has a hook 21 that engages over and embraces the trunnion collar 16 when the trunnion groove is seated in the bearing slot as shown in FIG. 5.

Figure 2:
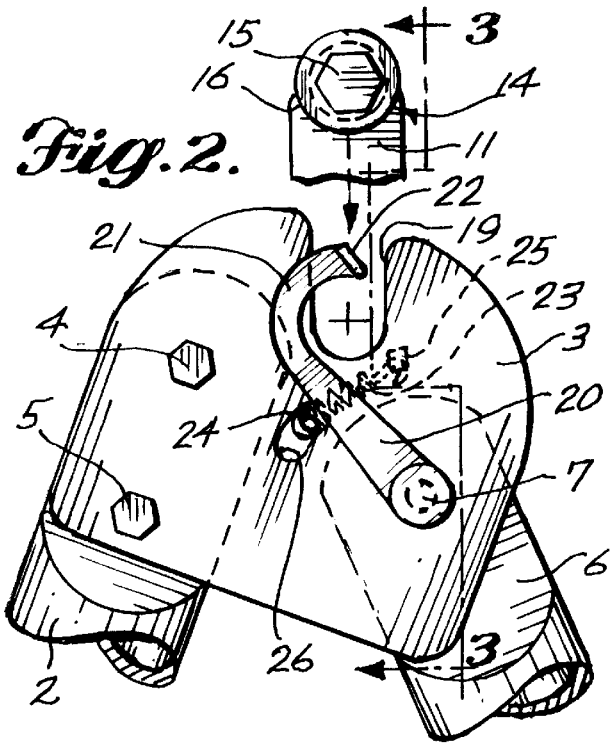
FIG. 2 is an enlarged detail side elevation of a table mount showing parts in separated relationship.
Figure 3:
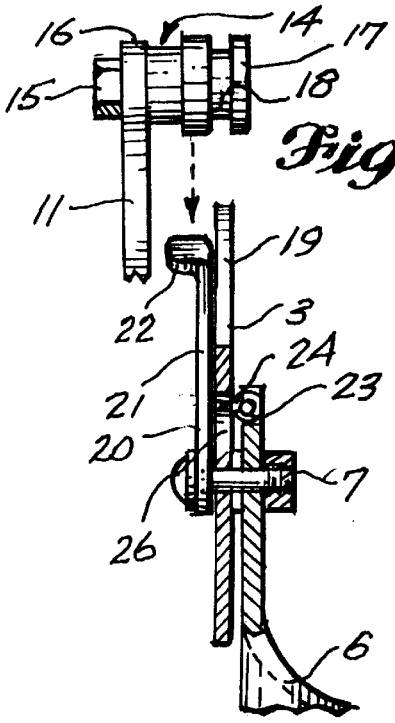
FIG. 3 is a vertical section through the table mount of FIG. 2 taken on line 3—3 of that figure.
Figure 4:
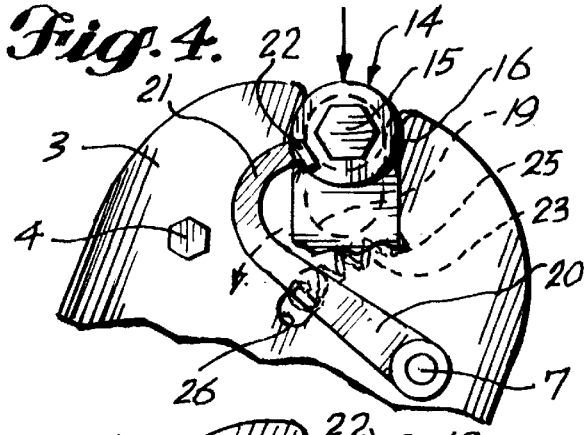
FIG. 4 is a side elevation of a table mount similar to FIG. 2 but showing parts in a different relationship.
Figure 7:
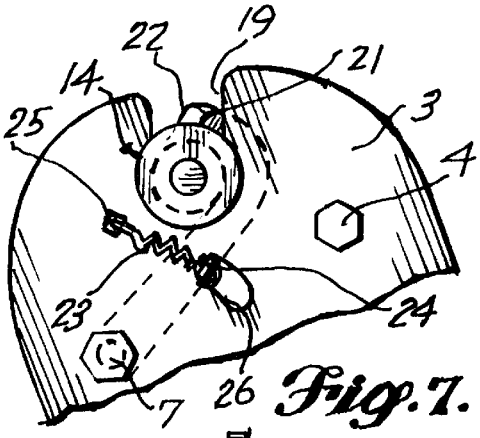
FIG. 7 is side elevation of a table mount viewed from the side opposite that shown in FIG. 5.

A tab 22 projects transversely from the swinging end of the keeper 20, 21 in a position to be engaged by the trunnion collar 16 as the trunnion 14 is lowered from the position shown in FIG. 2 to the position shown in FIG. 4 relative to the bearing slot 19. Depression of the trunnion from the position shown in FIG. 4 to the position shown in FIG. 5 will effect such engagement of the collar 16 with the tab 22 as to swing the keeper hook 21 aside so that the trunnion can pass into the bearing slot 19. Alternatively, the keeper can be swung in this fashion by manually grasping the tab 22 serving as a handle for seating the trunnion in the bearing slot or for removing the trunnion from the bearing slot.

Figure 8:
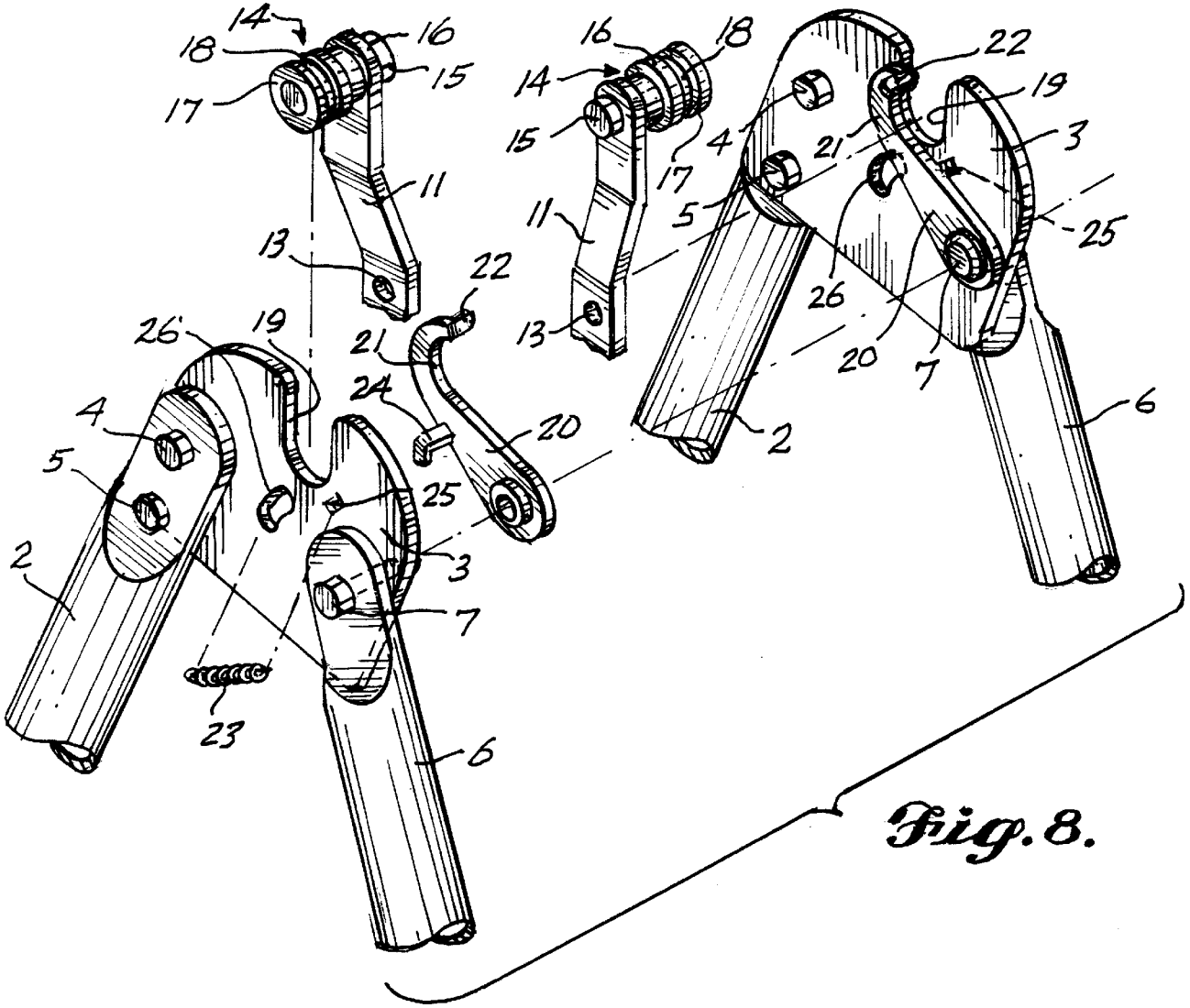
FIG. 8 is a top perspective of two cooperating table mounts showing parts in exploded relationship.

The keeper is normally held in the active position shown in FIGS. 2 and 5 relative to the apex plate 3 by holding means including a helical tension spring 23 having one end secured to a lug 24 projecting from the side of the keeper as shown best in FIG. 8. The other end of the tension spring 23 is anchored to a projection 25 carried by the apex plate 3 as shown in FIGS. 2, 4, 5, 7 and 8. When the keeper arm is deflected to the released position of FIG. 4, whether by manual manipulation of tab 22 or by pressure of collar 16 on such tab in opposition to the force of the spring 23 such spring is stretched and the lug 24 moves along the slot 26 in apex plate 3 which slot is of circular arcuate shape concentric with the pivot 7.

The tilting inversion exercise table 1 may be equipped with a foot support at one end and ankle holders 27 which may be generally of the type shown in Teeter U.S. Pat. No. 4,515,152, issued May 7, 1985 secured to the foot end of the table.

In use, a person having his feet secured to the table can swing the table from the generally horizontal position shown in full lines in FIG. 1 into the generally upright position shown in broken lines in FIG. 1 about the axes of the trunnions 14 to invert the exerciser. A stop or stops 28 mounted on the stand legs 6 may be provided to be engaged by the tilting table 1 to limit its extent of swing relative to the stands about the trunnions 14.

Figure 6:
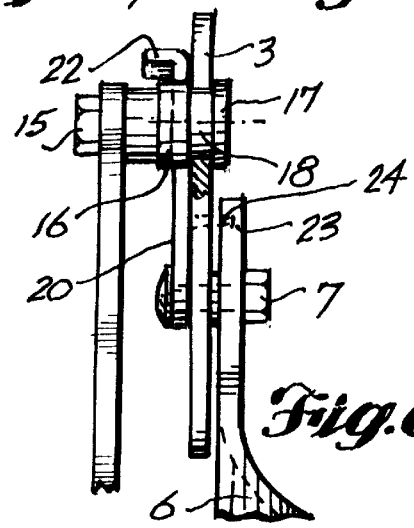
FIG. 6 is an edge elevation of a table mount taken at right angles to FIG. 5 with parts broken away.

The person using the exercise table may swing it violently and may even roll from side to side. Whatever jostling may be applied to a trunnion 14, it will be retained securely in its bearing slot 19 in the position shown in FIGS. 5, 6 and 7 by engagement of the keeper hook 21 with the collar 16 of the trunnion.

I claim:

1. A mount for a tilting inversion exercise table including stand means having spaced trunnion-supporting bearing plates and trunnions carried by the tilting inversion exercise table bearing on the bearing plates, the improvement comprising keeper means movable relative to their trunnion-supporting bearing plates between active positions preventing the trunnions from being removed from bearing engagement with the trunnion-supporting bearing plates and released positions in which the trunnions can be removed from the bearing plates, and spring holding means for maintaining said keeper means in their active positions.

2. The mount defined in claim 1, in which the trunnion-supporting bearing plates have upwardly-opening blind bearing slots for receiving the trunnions, and each keeper means includes a swingable keeper arm pivoted on a trunnion-supporting bearing plate and swingable into an active position preventing the escape of a trunnion from its trunnion-supporting bearing plate blind bearing slot.

3. The mount defined in claim 2 in which the spring holding means normally holds the keeper means arm in active position preventing escape of the trunnion from its trunnion-supporting bearing plate blind bearing slot.

4. The mount defined in claim 2, in which the spring holding means includes a helical tension spring connected between the swingable keeper arm and the trunnion-supporting bearing plate for normally holding the keeper arm in active position preventing escape of the trunnion from its trunnion-supporting bearing plate blind bearing slot.

5. The mount defined in claim 3, in which the keeper means is positioned for engagement of its arm by the trunnion being moved into its trunnion-supporting bearing plate blind bearing slot to effect movement of such arm from active position to released position in opposition to the force of the spring holding means for enabling the trunnion to be moved into the trunnion-supporting bearing plate blind bearing slot past the keeper means arm.

* * * * *